US006581764B1

(12) United States Patent
Hillebrand

(10) Patent No.: US 6,581,764 B1
(45) Date of Patent: Jun. 24, 2003

(54) CONVENIENT, DISPOSABLE ARTICLE FOR FOOD PACKAGING

(76) Inventor: Cory Hillebrand, 5122 Hampton Lake Dr., Atlanta, GA (US) 30068

( * ) Notice: Subject to any disclaimer, the term of this patent is extended or adjusted under 35 U.S.C. 154(b) by 0 days.

(21) Appl. No.: 09/603,228

(22) Filed: Jun. 26, 2000

Related U.S. Application Data

(60) Provisional application No. 60/181,921, filed on Feb. 11, 2000.

(51) Int. Cl.[7] ..... B65D 69/00

(52) U.S. Cl. ..... 206/225; 206/397; 206/820

(58) Field of Search ..... 206/225, 397, 206/820; 426/107, 109, 241, 243, 234; 229/902

(56) References Cited

U.S. PATENT DOCUMENTS

| | | | | | |
|---|---|---|---|---|---|
| RE20,564 | E | * | 11/1937 | Salfisberg | 206/820 |
| 2,759,830 | A | | 8/1956 | Touceda | |
| 2,830,910 | A | | 4/1958 | Swanson | |
| 2,902,371 | A | | 9/1959 | Shorr | |
| 3,012,894 | A | | 12/1961 | Nagel | |
| 3,185,372 | A | | 5/1965 | Ferraro | |
| 3,224,574 | A | * | 12/1965 | McConnell et al. | 206/397 |
| 3,283,422 | A | * | 11/1966 | Nygard | 206/820 |
| 3,286,831 | A | * | 11/1966 | Giberstein | 206/820 |
| 3,291,377 | A | | 12/1966 | Eggen | |
| 3,411,433 | A | | 11/1968 | Christopher | |
| 3,836,064 | A | | 9/1974 | Stillwagon | |
| 3,984,592 | A | | 10/1976 | Stillwagon | |
| 4,015,085 | A | * | 3/1977 | Woods | 219/729 |
| 4,267,420 | A | * | 5/1981 | Brastad | 426/107 |
| 4,488,642 | A | * | 12/1984 | Changani et al. | 206/345 |
| 4,579,278 | A | | 4/1986 | Altus | |
| 4,697,732 | A | | 10/1987 | Altus | |
| 4,715,500 | A | * | 12/1987 | Heylen et al. | 206/397 |
| 4,775,771 | A | * | 10/1988 | Pawlowski et al. | 219/730 |
| 4,784,864 | A | * | 11/1988 | Ikeda | 426/115 |
| 4,886,179 | A | | 12/1989 | Volk | |
| 4,911,938 | A | * | 3/1990 | Fisher et al. | 219/727 |
| 4,938,608 | A | * | 7/1990 | Espinosa | 383/35 |
| 4,940,867 | A | * | 7/1990 | Peleg | 219/730 |
| 5,180,894 | A | * | 1/1993 | Quick et al. | 219/730 |
| 5,217,768 | A | * | 6/1993 | Walters et al. | 219/730 |
| 5,225,287 | A | * | 7/1993 | Perry et al. | 428/328 |
| 5,357,086 | A | * | 10/1994 | Turpin et al. | 219/725 |
| 5,399,366 | A | | 3/1995 | Geddes et al. | |
| 5,497,913 | A | * | 3/1996 | Baker | 383/37 |
| 5,560,945 | A | | 10/1996 | Geddes et al. | |
| 5,571,627 | A | * | 11/1996 | Perry et al. | 219/725 |
| 5,585,027 | A | * | 12/1996 | Young | 219/730 |
| 5,654,075 | A | | 8/1997 | Ramirez | |
| 5,857,564 | A | * | 1/1999 | Hymowitz | 206/209 |
| 5,884,763 | A | * | 3/1999 | Ozawa | 206/397 |
| 5,988,882 | A | * | 11/1999 | Fisher et al. | 383/207 |

* cited by examiner

*Primary Examiner*—Shian Luong

(57) ABSTRACT

An article for packaging food is provided in which the article comprising a triangularly shaped top layer of a first flexible material, such as aluminum foil, having two sealing edges and one opening edge, and a triangularly shaped bottom layer of a second flexible material having two sealing edges and one opening edge, wherein the sealing edges of the top layer are secured to the sealing edges of the bottom layer, thereby forming a conical pouch between the top layer and the bottom layer. The pouch has an opening between the opening edges into which food items can be inserted and then the opening edges folded together to close the pouch. The top layer preferably includes perforations that facilitate tearing open the top layer, for example, during or following reheating of the food item. The packaging articles can be provided in a sheet form having one or more rows of the packaging articles, wherein each row comprises two or more of the articles integrally formed together, such that each article is removably connected to another article, preferably by having perforations between the articles. The sheet can be provided to the user as a cylindrical roll, from which the user can tear off an individual packaging article as needed. Food items, such as slices of pizza, can be placed into the pouch opening of packaging article, and then the opening edge of the top layer and the bottom layer can be pinched together and folded to close the pouch.

5 Claims, 5 Drawing Sheets

CONVENIENT, DISPOSABLE ARTICLE FOR FOOD PACKAGING

CROSS-REFERENCE TO RELATED APPLICATIONS

Priority is claimed to U.S. provisional application Serial No. 60/181,921, filed Feb. 11, 2000.

BACKGROUND OF THE INVENTION

The articles and methods of manufacture described herein are generally in the field of packaging devices for food storage and reheat.

Food items left over after a meal typically are packaged for temporary storage in a refrigerator or freezer for later reheating and consumption. Plastic containers, such as TUPPERWARE™, can be used, but are not always of a suitable size and may not be suitable for placement into a conventional oven to reheat the food items. This is inconvenient and necessitates transferring the food to another, oven compatible container before the food can be reheated.

Plastic and foil wraps can be used for packaging the food items. Plastic wraps, however, also typically are not suitable for use in conventional ovens. Foil wraps can be used in conventional ovens; however, some food items cannot easily and conveniently be wrapped in foil wraps so as to completely seal and protect the food during storage, without using excessive amounts of the foil wrap. This problem is particular true when the food item is a slice of pizza, which often is in the shape of wide, somewhat flat triangle. With conventional foil wraps, it also can be inconvenient or difficult to selectively open the wrapped food to expose the top of the food item to heat in the oven while keeping the bottom portion of the food item covered, since foil wraps typically tear easily and along uncontrollable directions.

It would therefore be desirable to have a packaging container which protects food during storage; which can be used in a conventional oven; and which is convenient to use (both when inserting and removing the food item), inexpensive, and disposable. It would be particularly desirable to have such a packaging container to accommodate food items in the general shape of a slice of pizza.

It is therefore an object of the present invention to provide a packaging container which protects food during storage, can be used in a conventional oven, is convenient to use, and disposable.

It is another object of the present invention to provide a method of manufacturing such packaging containers in large quantities.

It is a further object of this invention to provide a convenient and cost effective means for the end user to store and dispense the packaging containers.

SUMMARY OF THE INVENTION

An article for packaging food is provided in which the article comprising a triangularly shaped top layer of a first flexible material having two sealing edges and one opening edge, and a triangularly shaped bottom layer of a second flexible material having two sealing edges and one opening edge, wherein the sealing edges of the top layer are secured to the sealing edges of the bottom layer, thereby forming a conical pouch between the top layer and the bottom layer. The pouch has an opening between the opening edges into which food items can be inserted and then the opening edges folded together to close the pouch. The top layer preferably includes perforations that facilitate tearing open the top layer during or following reheating of the food item.

The packaging article preferably is formed of two layers of a metal foil, such as aluminum foil, wherein the sealing edges are fused together. The packaging article preferably is in the shape of an isosceles or equilateral triangle. In a preferred embodiment, the height of this triangle is between about 10 inches and about 16 inches, more preferably about 14 inches, and the length of the base of the triangle is between about 8 inches and about 16 inches, more preferably about 12 inches.

In another aspect, a sheet including one or more rows of the packaging articles is provided. Each row comprises two or more of the articles integrally formed together, and provided such that each article is removably connected to another article, preferably by having perforations or scoring between the articles. The sheet can be provided to the user in the form of a cylindrical roll, from which the user can tear off an individual packaging article as needed. Alternatively, the packaging articles can be separated and stacked individually, or sheets (or rows) of the packaging articles can be folded back and forth, and then either the stacks or folded sheets packed flat, for example, in a carton.

A efficient method of manufacturing the packaging article is provided. In the method, a top sheet of a first flexible material, wherein the top sheet has an outer surface and an inner surface, and a bottom sheet of a second flexible material, wherein the bottom sheet has an outer surface and an inner surface, are provided. Then, the inner surface of the top sheet is positioned adjacent to or in contact with the inner surface of the bottom sheet, and select areas of the inner surfaces are secured (e.g., fused or adhered) together, thereby defining sealing edges of one or more triangularly shaped pouches between the top layer and the bottom layer. The method can further include forming perforations or scores in the top sheet, and when the sheets include two or more of the triangularly shaped pouches, the method can further include forming perforations or scores in both the top sheet and the bottom sheet at the sealing edges between the pouches, to facilitate separation of the pouches from one another.

Food items, such as slices of pizza, can be placed into the pouch opening of packaging article, and then the opening edge of the top layer and the bottom layer can be pinched together and folded to close the opening of the pouch. The article and food can then be stored, such as in a refrigerator or freezer. Then when it is desired to eat the food item, the package can be opened, preferably by tearing the top layer along the opening perforations. The food item can be (re)heated, such as in a conventional oven, while sealed in the packaging article or after the top layer has been opened such that the food item rests on the bottom layer of the packaging article.

DETAILED DESCRIPTION OF THE INVENTION

A packaging article is provided to facilitate the convenient, storage, and reheating of food items, especially slices of pizza. Preferably, each article is sized to contain an ordinary size of a single slice of pizza.

The Article

Figure 1:
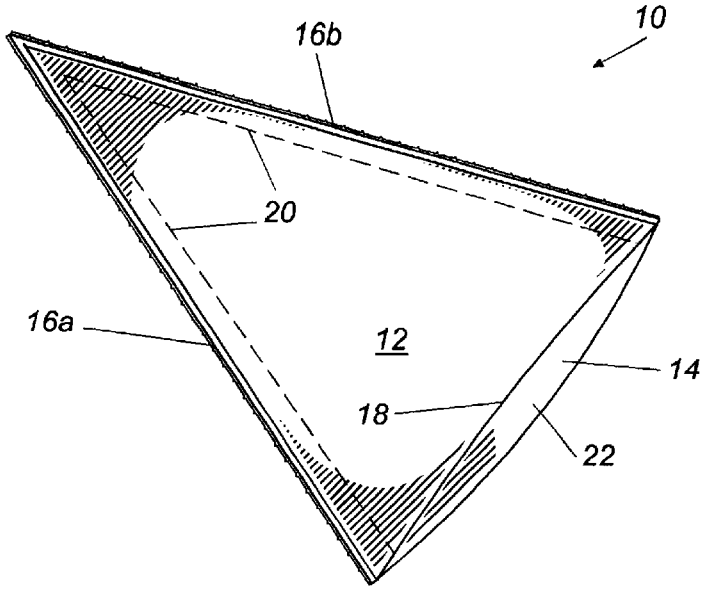
FIG. 1 is a perspective view of a preferred embodiment of the food pouch.

A preferred embodiment of the packaging article is shown in FIG. 1. Packaging article 10 includes top layer 12 and bottom layer 14. The top layer 12 has two sealing edges 16*a* and 16*b* and one opening edge 18, and includes opening perforations 20. The bottom layer 14 is essentially identical to top layer 12, but without perforations 20. Together the top layer and the bottom layer form a pouch having opening 22. The packaging article is triangularly shaped. As used herein, the term "triangularly shaped" includes isosceles or equilateral triangles, and trapezoidal shapes that are substantially triangular. The height of the "triangle" of the packaging article preferably is between about 10 inches and about 18 inches, more preferably about 12 to 14 inches, and the length of the base of the triangle (along the opening edge) preferably is between about 8 inches and about 16 inches, more preferably about 12 inches (see FIG. 2).

Figure 2:
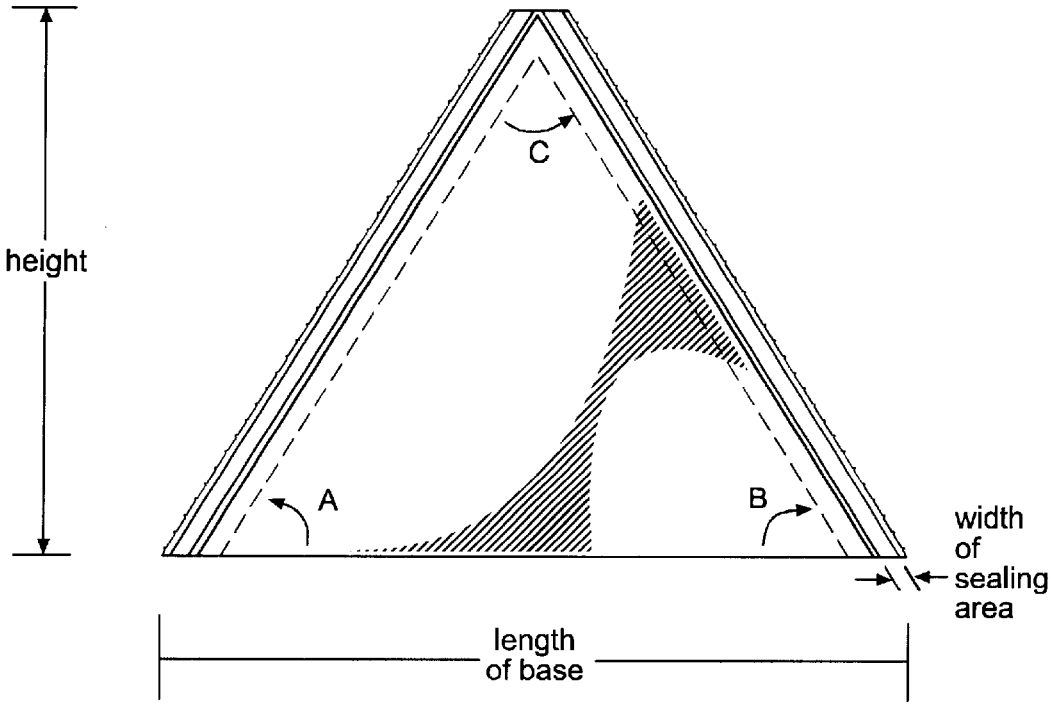
FIG. 2 is a top view of a preferred embodiment of the food pouch.

In a preferred embodiment, with reference to FIG. 2, angle A=angle B=66.8°, such that angle C is 46.4°.

The top layer 12 and bottom layer 14 are formed of a flexible material, preferably approved by the U.S. Food & Drug Administration for direct contact with food. In a preferred embodiment, the flexible material is a metal foil, such as aluminum foil. Other materials of construction, such as paper, polymers, or composites thereof, can be used or laminated to the metal foil. For example, in one embodiment, a food grade non-stick material is coated onto the inner surface of the top layer and/or the bottom layer to prevent food items from adhering to the packaging article. Each layer preferably is formed of standard gauge heavy duty household foil, which typically is about 0.001 inches thick. Suitable gauges for the foil are between about 0.0005 and 0.005 inches thick.

Opening perforations 20 or scoring can be positioned essentially anywhere on the packaging article 10, but preferably are patterned to facilitate easy tear opening/folding back of the top layer, for example for convenient exposure of the pizza or other food item when reheating the food resting on the bottom layer. In a preferred embodiment, the perforations are in a line parallel to sealing edges 16*a* and 16*b*, and offset approximately 0.375 to 0.5 inches from the edge (see FIG. 2).

The top and bottom layers are secured together at their respective sealing edges. Specifically, the selected areas of the inner surface of the top sheet are secured to selected areas of the inner surface of the bottom sheet along the sealing edges (16*a* and 16*b* and their mirror image counterpart edges on the bottom layer), wherein the width of the sealing area is preferably less than about 0.5 inches, more preferably about 0.0625 to 0.125 inches (see FIG. 2). The sealing edges preferably are secured by fusion or adhesion. The preferred fusion method is ultrasonic welding.

Figure 3:
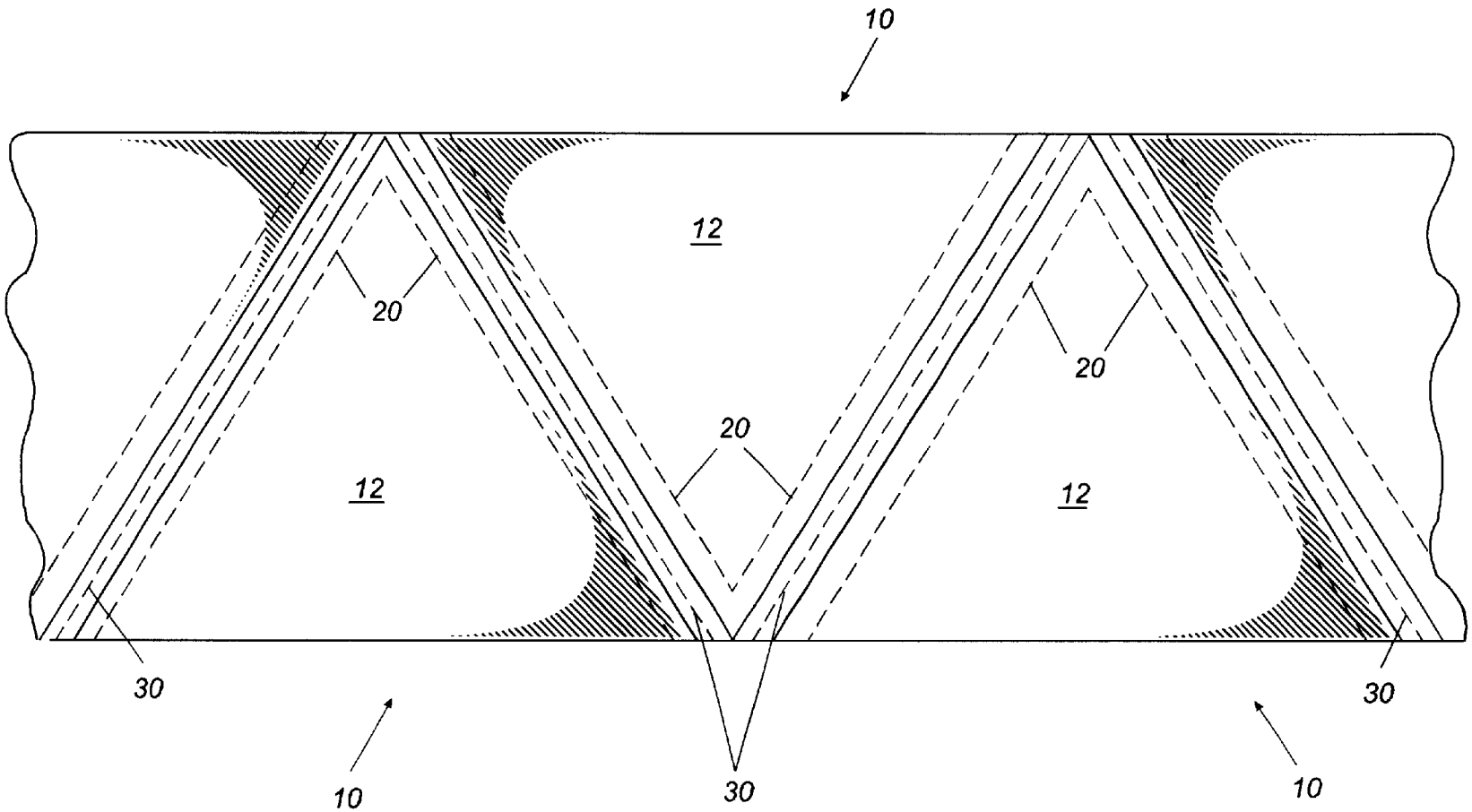
FIG. 3 is a top view of one embodiment of a sheet of several of the food pouches, in a single row.
Figure 4:
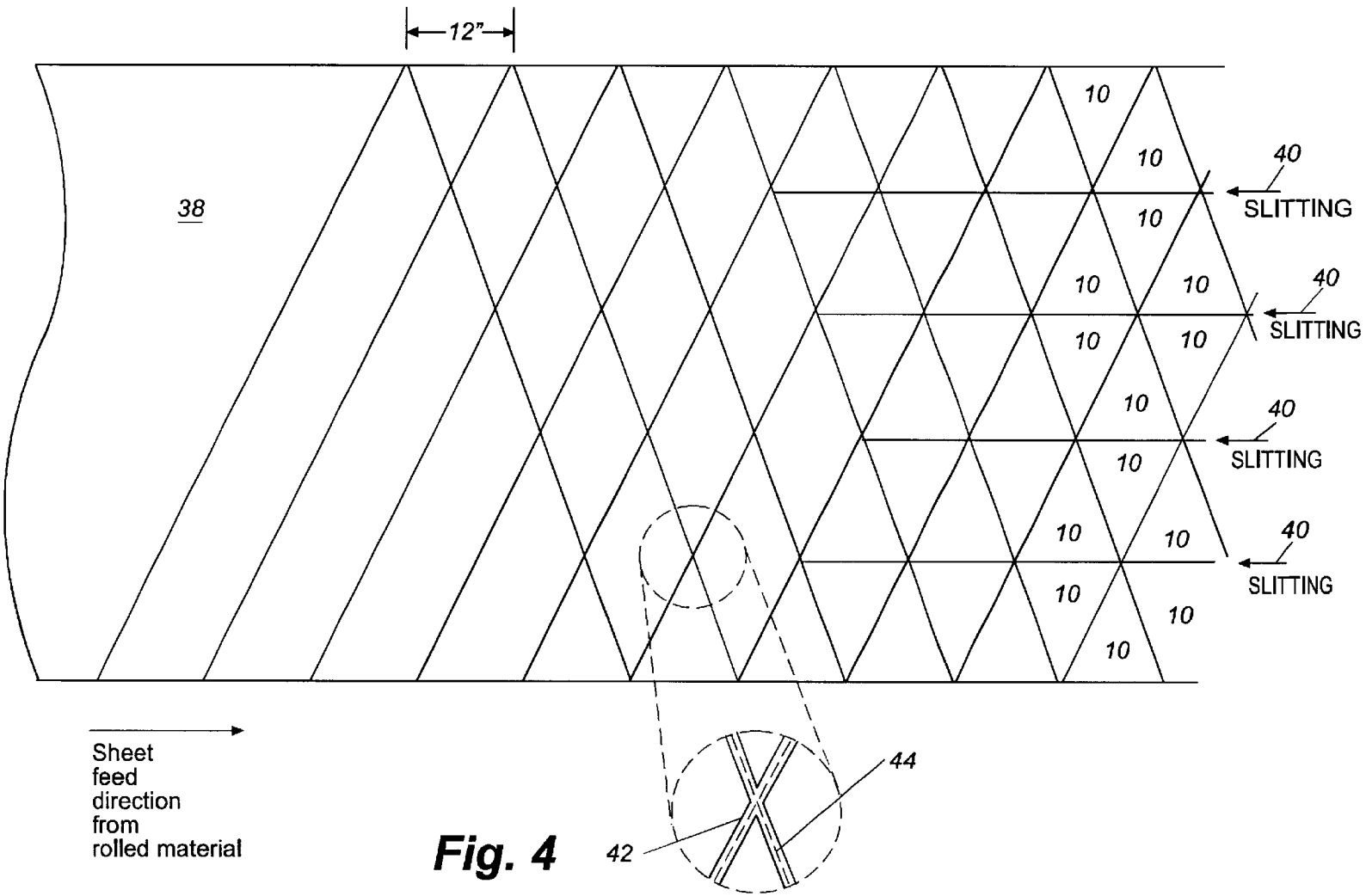
FIG. 4 is a top view of one embodiment of a manufacturing process making a sheet of several of the food pouches in multiple rows.

In one embodiment, as shown in FIGS. 3 and 4, the packaging articles are provided in sheets comprises one or more rows of the articles, wherein each row includes two or more, preferably ten or more, of the articles integrally formed together. The articles 10 preferably are removably connected to another article, such as by providing perforations or scoring 30 between the articles. In a preferred embodiment, each sheet or row is wrapped around itself in the form of a cylindrical roll. It can be wrapped around a rigid paper or cardboard cylinder.

Alternatively, the packaging articles can be separated individually, or sheets of the packaging articles can be folded back and forth, and either the stacks or folded sheets packed flat, for example, in a carton.

Manufacturing the Article

In a preferred embodiment, the packaging article is manufactured in a continuous sheet format, wherein the top layer and bottom layer are standard running foil sheets of standard fixed width and a length which can varying. This yields a series of connected articles (as shown in FIGS. 3 and 4), which can be separated at the separation perforations. In this process, the top layer 12 is manufactured, and optionally perforated (or scored) to form the opening perforations 20. Then, portions of the top layer are fused or adhered to portions of the bottom layer in a series of strips forming the edges of the packaging articles, using fusing or other equipment known in the art for adhering together sheets of material. Finally, the upper and lower layers are both perforated or scored to form the separation perforations 30. The separation perforations can be formed in the same operation step (i.e. at essentially the same time) as the fusion/adhering of the top and bottom layers or perforation alternatively can take place in a separate, subsequent or prior, step.

As shown in FIG. 4, sheet widths greater than a single row of packaging articles 10, preferably in multiples of the standard width, can be used in the manufacturing process. Then, after the plies are fused together and scored, the large sheet can be fed through slitter 40 to form two, three, or more rows (five rows are shown), as appropriate based on the fusion and perforation patterns and the overall sheet width. FIG. 4 illustrates one embodiment of the manufacturing process showing a sheet of material 38 being fed through a continuous welding, scoring, and slitting process. An identical sheet (not shown) is beneath sheet 38 and being welded to sheet 38. In the embodiment shown, weld line 42 preferably is ¼ inch wide and has perforation 44 along the center of the weld line. In the embodiment shown, the sheet width is about 72 inches, and the distance between two parallel perforations 44 on the sheet is about 12 inches. Slitting can occur before or after welding and/or scoring. For example, slitting of the foil sheets to a narrower width may occur before the welding step.

FIG. 4 illustrates simultaneously forming five rows of the packaging articles from the top and bottom sheets; however, fewer rows, for example two rows, may be preferred for lower initial manufacturing capital costs, for example, associated with the ultrasonic welding and perforating equipment.

Figure 6:
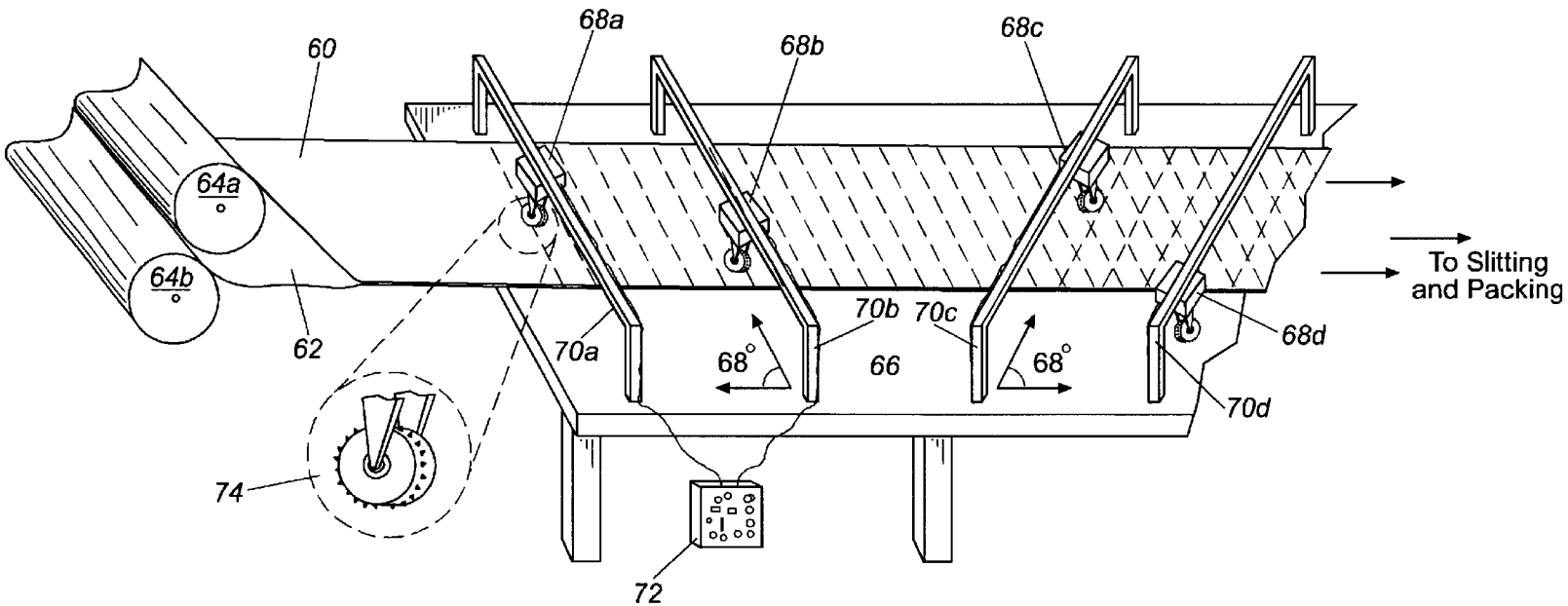
FIG. 6 is a perspective view of one embodiment of a production process layout for making a sheet of several of the food pouches in multiple rows using ultrasonic welding.

The equipment for welding and scoring is not shown in FIG. 4. However, FIG. 6 shows one embodiment of a production process layout for making a sheet of several of the food pouches in multiple rows using ultrasonic welding equipment. FIG. 6 shows top sheet material 60 and bottom sheet material 62 being unrolled from reels of sheet material 64*a* and 64*b*, respectively, and fed together across surface 66 forming a 2-ply material. The two plies (top sheet material 60 and bottom sheet material 62) then are fused together using a series of ultrasonic welding heads 68*a*, 68*b*, 68*c*, and 68*d*, which move across the material.

In this embodiment, the sheets are incrementally grip fed across surface 66, and welding heads 68*a* and 68*b* move back and forth across the sheets at reverse angles (e.g., 68°) from welding heads 68*c* and 68*d*, thereby forming desired criss-crossing weld lines. Welding heads 68*a*, 68*b*, 68*c*, and 68*d* are automated and move along fixed tracks 70*a*, 70*b*, 70*c*, and 70*d*, respectively, under computer 72 control. Alternatively, the desired criss-crossing weld lines can be formed on continuously fed sheets using welding heads that move, for example, back and forth perpendicularly across the moving sheets at a rate such that the weld lines are made at the desired angle.

The embodiment in FIG. 6 also shows an example of special tooling 74 associated with the weld heads which provide near simultaneous formation of perforations, e.g., as a roller having a series of raised protrusions projecting from the surface of a roller wheel, which is positioned, e.g., as a horn adapted to a weld head, to lead or trail the weld head contact point. The scoring or perforation alternatively can take place in a separate step, using separate equipment.

Each row can then be cut into the desired length, such that each length contains a fixed, whole number of packaging articles, which can be placed into final product packaging, typically as a roll of several of the articles in a dispenser, to be provided to the end user.

Dispenser for the Articles

The article preferable is provided to the end user in a convenient roll of a sheet of the articles, typically in a carton for ease of dispensing the articles one at a time for use. In a preferred embodiment, the carton has a rectangular shape of standard dimensions for containing commercially available rolls of aluminum foil, wax paper, or plastic wrap for food packaging, which typically are sold, for example, in grocery stores. Such standard paperboard cartons preferably are provided with a tear starter useful for separating articles from one another and for avoiding tearing at the wrong place on the foil.

Figure 5:
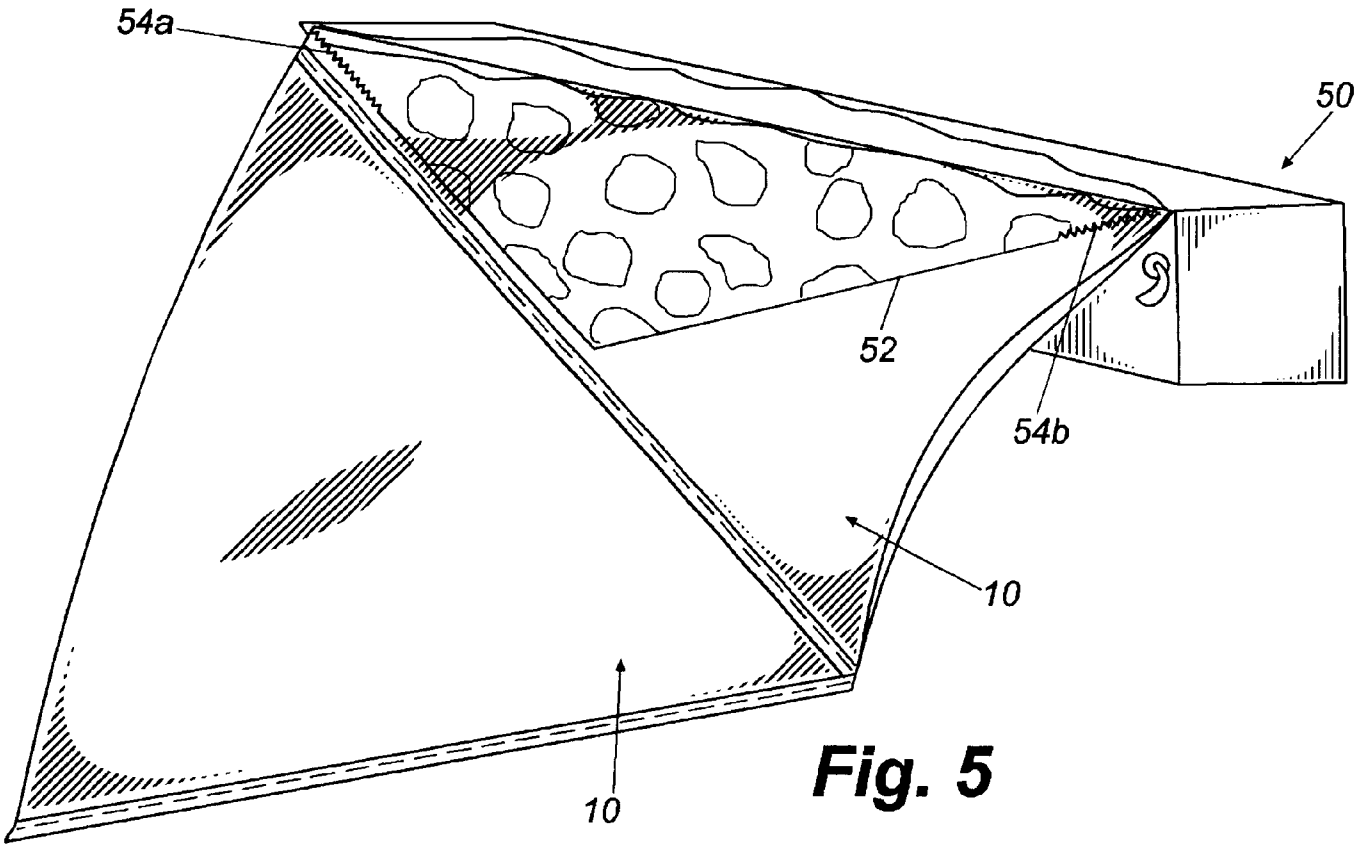
FIG. 5 is a perspective view of one embodiment of a dispensing carton for the packaging articles.

An example of one embodiment of a dispensing carton for a roll of the packaging articles is shown in FIG. 5. Dispensing carton 50 has a top flap 52 which includes tear starters 54*a* and 54*b* for separating packaging articles 10 from one another as the packaging articles are pulled (unrolled) from the dispensing carton. Due to the angled perforation in alternating directions between packaging articles, tear starters 54*a* and 54*b* are present near the edges of the sheet/carton and should facilitate tearing at an angle less than 90° relative to the edge, preferably about 67°. In the embodiment shown, tear starters 54*a* and 54*b* are perforated cutter paper board starters integral with top flap 52 and preferably are between about 1 and 2 inches long. In the embodiment shown, triangular shaped top flap 52 is provided with a photoprint of pizza for product shelf appeal to the end user/purchaser.

Using the Article

Food items, particularly slices of pizza, can be placed into the pouch opening of the packaging article, and then the opening edge of the top layer and the bottom layer can be pinched together and folded to close the opening of the pouch. The article and food can then be stored, such as in a refrigerator or freezer. Then when it is desired to eat the food item, the package can be opened, preferably by tearing the top layer along the opening perforations and then heated, for example, on the bottom layer of the packaging article directly in a microwave or conventional oven.

Those skilled in the art will recognize, or be able to ascertain using no more than routine experimentation, many equivalents to the specific embodiments of the invention described herein. The references cited herein are hereby incorporated by reference.

I claim:

1. A kit for dispensing articles, comprising (i) a roll of a sheet of interconnected articles, each article comprising a top layer of a first flexible material comprising a metal foil having a thickness between about 0.0005 and 0.005 inches, wherein the layer is triangularly shaped and has two sealing edges and one opening edge, and a bottom layer of a second flexible material comprising a metal foil having a thickness between about 0.0005 and 0.005 inches, wherein the layer is triangularly shaped and has two sealing edges and one opening edge, wherein the sealing edges of the top layer are secured to the sealing edges of the bottom layer, thereby forming a pouch between the top layer and the bottom layer, the pouch having an opening between the opening edges for receiving the food article, and wherein the sheet comprises perforations or scoring between the articles, and the sheet is in the form of a cylindrical roll; and (ii) a dispensing carton in which the roll can be contained and from which the sheet can be unrolled, comprising a box-shaped body having an opening through which an end of the sheet can be extracted; and a flap pivotably secured to the body and positionable over the opening of the body, the flap being triangular shaped and comprising first and second edges, each of the first and second edges having a straight portion and an integral tear starter positioned adjacent the body, wherein contiguous articles on the roll are separable from the roll by the respective tear starters located on the first and second edges.

2. The kit of claim 1 wherein the first flexible material and the second flexible material of the article consist essentially of aluminum foil.

3. The kit of claim 1 wherein the top layer and/or the bottom layer of the article is provided with a non-stick coating.

4. The kit of claim 1 wherein the top layer of the article comprises perforations or scoring that facilitate tearing of the top layer.

5. The kit of claim 4 wherein the perforations or scoring are in the form of two lines substantially parallel to and offset from the two sealing edges.

* * * * *